United States Patent [19]

Schacht

[11] 4,263,639

[45] Apr. 21, 1981

[54] LIGHT DISPERSION SYSTEM WITH SUBSTITUTED DIFFUSION PANELS

[76] Inventor: Louis L. Schacht, 278 Crosse Dr., Cranbury, N.J. 08512

[21] Appl. No.: 77,947

[22] Filed: Sep. 24, 1979

[51] Int. Cl.[3] ..... F21S 1/14

[52] U.S. Cl. ..... 362/147; 362/404

[58] Field of Search ..... 362/147, 148, 150, 404, 362/408, 432

[56] References Cited

U.S. PATENT DOCUMENTS

| | | | |
|---|---|---|---|
| 2,734,126 | 2/1956 | Kruger | 362/150 |
| 2,772,742 | 12/1956 | Sprankle | 362/148 X |
| 2,978,573 | 4/1961 | Kalbrunner | 362/147 |
| 3,144,633 | 8/1964 | Germain | 362/408 X |
| 3,308,288 | 3/1967 | Ades | 362/150 |
| 3,460,299 | 8/1969 | Wilson | 362/150 |
| 3,471,981 | 10/1969 | Segil et al. | 362/150 X |
| 3,545,145 | 12/1970 | Yousefpor | 362/404 X |
| 4,164,011 | 8/1979 | Sherwood | 362/408 X |
| 4,186,433 | 1/1980 | Baldwin | 362/408 X |

*Primary Examiner*—Peter A. Nelson

*Attorney, Agent, or Firm*—Natter & Natter

[57] ABSTRACT

An improved light dispersion system for fluorescent lighting fixtures includes a plurality of horizontal diffuser panels suspended below a light source. An upper set of diffuser panels are spaced apart to define a light passageway. A lower diffuser panel is positioned in registration with the light passageway for intercepting and reflecting incident light. Both the upper and lower diffuser panels further scatter transmitted light by refraction. A chromatic lens filter is selectively insertable within the light passageway for modifying the resultant color spectrum.

10 Claims, 7 Drawing Figures

FIG. 1
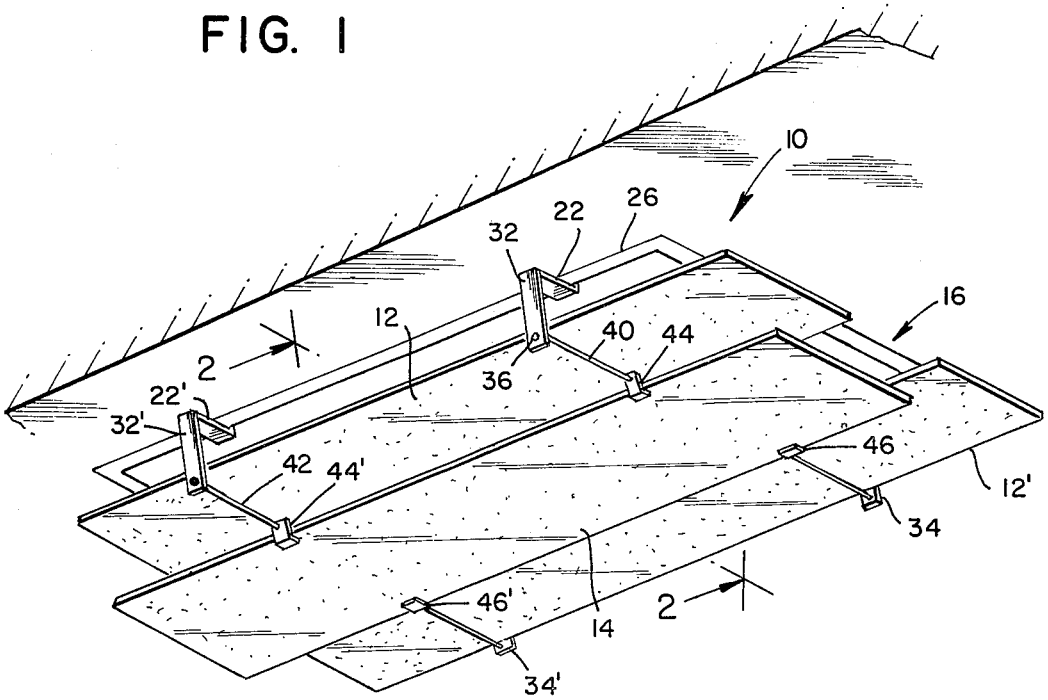
FIG. 2
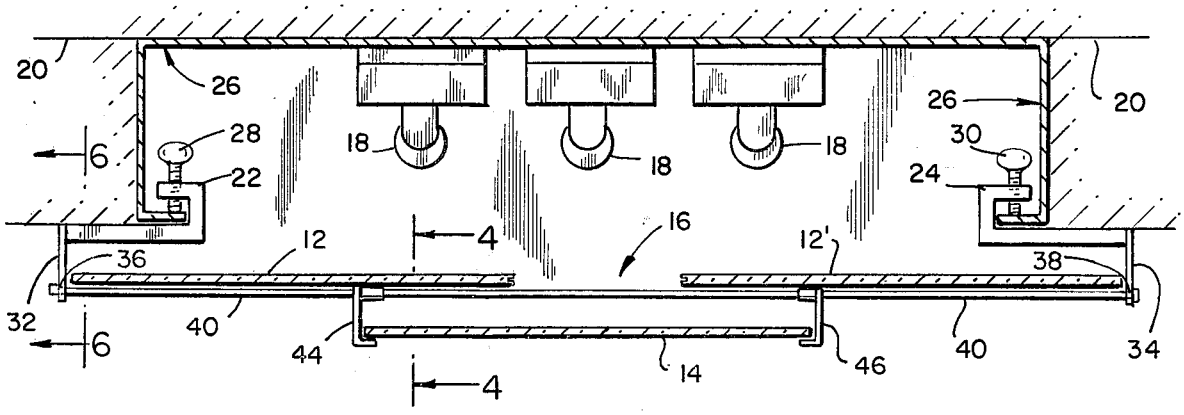
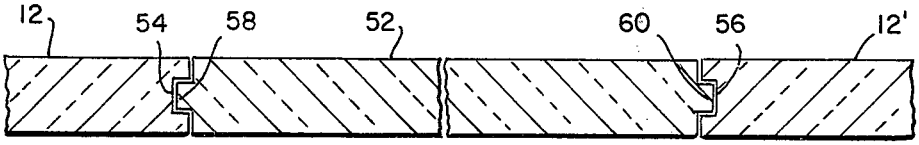
FIG. 3

FIG. 4
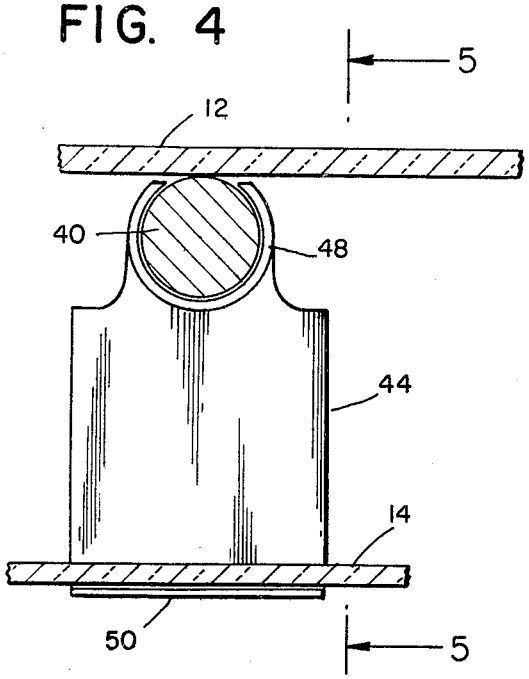
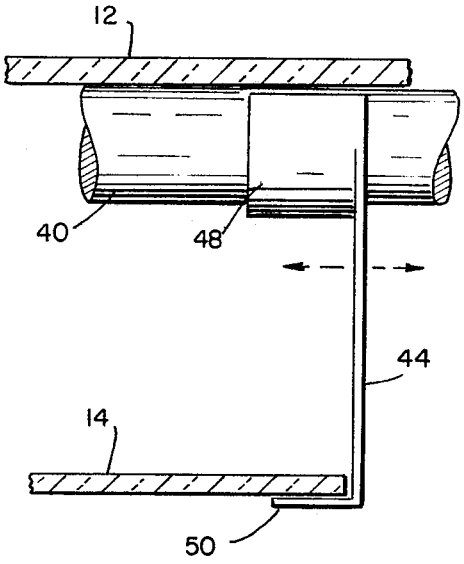
FIG. 5
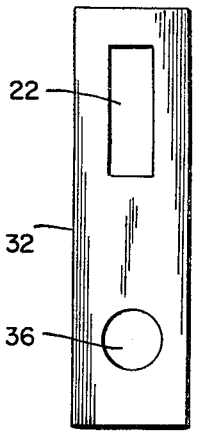
FIG. 6
FIG. 7
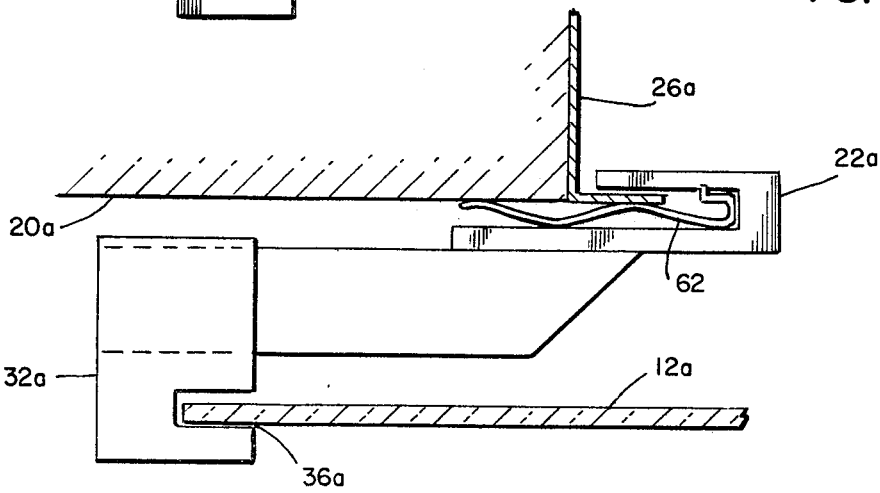

LIGHT DISPERSION SYSTEM WITH SUBSTITUTED DIFFUSION PANELS

BACKGROUND OF THE INVENTION

1. Field of the Invention

This invention relates to lighting fixtures and especially to a light dispersion system for luminaires.

In particular, the device of this invention is concerned with an improved light dispersion system for a fluorescent lighting fixture.

2. Description of the Prior Art

The use of gas discharge lamps, such as fluorescent tubes was common for lighting purposes, such as in offices, factories and homes. Frequently, those fluorescent lighting units were housed within recessed or surface mounted fixtures or otherwise integrated into the ceiling for aesthetic reasons and/or construction cost economy. It was conventional to shield the fluorescent tubes with a diffuser panel which usually consisted of translucent plastic material releasably held to the lighting fixture. The diffusers were formed in various shapes such as a dropped dish plastic diffuser which projected downwardly from the fixture. The function of the diffuser as previously used was almost exclusively limited to dispersing the emitted light by refraction and further to shield the fluorescent tube from the sight line.

A disadvantage of these prior art diffusers is that they did not utilize reflection or multireflection for spreading light. In essence, much of the light generated was not released from within the fixture and therefore the light output and field of illumination was not maximized.

A further deficiency of the prior art fluorescent fixtures was that the light emitted from the conventionally available tubes does not contain a uniform distribution of the color spectrum. Frequently areas illuminated by fluorescent lighting make it difficult to distinguish between the color of some objects and also provide a rather harsh or cold lighting effect because the spectrum lacks certain wave lengths such as red and orange. The present invention overcomes some of these shortcomings by providing capabilities for selectively incorporating chromatic filter elements to modify the resultant light emission.

SUMMARY OF THE INVENTION

In compendium, this invention concerns an improved light dispersion system for a luminaire such as a fluorescent tube lighting fixture.

The dispersion system is particularly adaptable for ceiling mounted fluorescent units and incorporates a plurality of diffuser panels positioned in at least two different levels below the light source.

An uppermost diffuser panel is suspended within the light path and is designed to intercept and reflect incident light toward the ceiling and to redistribute transmitted light by refraction.

A lower registered diffuser panel is oriented to receive non-intercepted and transmitted light which is further spread for increasing the field of illumination.

A chromatic filter lens can be incorporated within the upper lens panel for supplementing the resultant color spectrum.

A feature of this invention is directed to its installation as a replacement in existing fixtures to increase the light output of the fluorescent fixture. For this purpose, a pair of mounting brackets which are compatible with commonly available fixtures are utilized to suspend the diffuser panels below the ceiling surface. The diffuser support arrangement also includes hanger members adapted to receive opposite ends of horizontal stringer elements. An upper diffuser panel is supported upon the horizontal stringer elements. A set of stirrup members depend from the horizontal stringers to provide a support for a lower diffuser panel.

It should be apparent that the diffuser panel support arrangement is readily adaptable for replacing existing diffuser panels in fluorescent fixtures.

From the foregoing summary, it will be appreciated that it is an object of the present invention to provide a light dispersion system for a luminaire of the general character described herein which is not subject to the disadvantages of the prior art.

Specifically, it is the object of this invention to provide a light dispersion system for providing a widespread light distribution and for increasing the light output of existing fluorescent fixtures.

Another object of this invention is to provide a light dispersion system which is easy to install and to remove for cleaning and relamping of the fixture.

Still another object of this invention is to provide a light dispersion system which is relatively economical to manufacture and readily adapted for use in the conversion of existing ceiling fixtures.

Yet another object of this invention is to provide a light dispersion system having at least two levels of horizontally mounted diffuser panels to selectively intercept light which is dispersed by reflection and refraction for spreading the field of illumination.

Still another object of this invention is to provide a light dispersion system wherein the diffuser panels are selectively interchangeable in accordance with desired light dispersion characteristics.

Yet another object of this invention is to provide a light dispersion system having the capability of introducing a color filter to modify the fluorescent light spectrum.

Other objects, features and advantages of this invention will be apparent and in part will be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more fully pointed out and indicated in the appended claims.

DESCRIPTION OF THE DRAWINGS

In the accompanying drawings in which are shown some of the preferred embodiments of this invention:

FIG. 1 is a perspective view of the light dispersion system of this invention showing a typical installation.

FIG. 2 is a sectional view to an enlarged scale viewed in the direction of lines 2—2 of FIG. 1 showing a pair of mounting brackets for securing a plurality of diffuser panels below a fluorescent tube lighting fixture;

FIG. 3 is a partial sectional view to an enlarged scale showing a chromatic filter retained between two diffuser panels;

FIG. 4 is a sectional view to an enlarged scale viewed in the direction of lines 4—4 of FIG. 2 showing a stirrup member for supporting a lower diffuser panel;

FIG. 5 is a sectional view taken substantially along lines 5—5 of FIG. 4 and showing the stirrup support member slidably positionable along a stringer member as indicated by the broken-line arrows;

FIG. 6 is a sectional view to an enlarged scale taken substantially along lines 6—6 of FIG. 2 showing a hanger member; and FIG. 7 is a partial sectional view of an alternate embodiment showing a spring-loaded bracket assembly for releasably securing a bracket support structure to a lighting fixture.

DETAILED DESCRIPTION OF THE INVENTION

Referring now in detail to the drawings, the reference numeral 10 denotes generally a light dispersion system of this invention. It should be noted that, although the light dispersion system 10 will be described hereinafter in conjunction with its use for fluorescent tube lighting fixtures, the device can have applications with other types of fixtures such as for incandescent lamps.

The dispersion system 10 is comprised of an upper set of diffuser panels 12, 12' and a lower diffuser panel 14. The panels 12, 12', 14 are designed to be suspended below a lighting fixture and to extend beyond the marginal periphery in a manner for increasing light scatterment. The upper diffuser panels 12, 12' are coplanar and are spaced from each other to provide a light passageway 16, approximately 4 inches (10 cm.) in width and coextensive with the panels 12, 12'. The lower panel 14 lies in a plane spaced approximately 2 inches (5 cm.) below the upper panels 12, 12'.

Typically, the diffuser panels 12, 12', 14 are fabricated from a polystyrene or acrylic sheet material having a translucent textured surface and optical characteristics for reflecting and refracting incident light. In this preferred embodiment, the panels are planar in configuration and each panel is 12 inches by 14 inches (approximately 30 cm. by 36 cm.). It should be further noted that the diffuser panels being identical in size and shape are readily adapted for interchangeable positioning. Furthermore, diffuser panels of different composition, surface texture or optical characteristics can be substituted in place of any one or more selected panels.

The light dispersion system 10 of this invention is adapted to replace existing diffusers as found in recessed, surface mounted and integrated ceiling lighting fixtures.

The upper set of diffuser panels 12, 12' and the lower diffuser panel 14 are adapted for placement below a light source such as a fluorescent discharge tube 18 within a lighting fixture 26 so as to intercept propagated wave lengths for reflection toward a ceiling surface 20 and elsewhere and for refraction of transmitted light in a manner which maximizes the light distribution.

The diffuser panel suspension arrangement will now be described in further detail. A pair of mounting brackets 22, 24 are adapted to be received within the existing light fixture 26 and will extend beyond the marginal periphery of the fixture. For this purpose, a thumb screw clamp 28, 30 is utilized to provide a releasable attachment which requires no special tools for installation. Furthermore, the fixture 26 provides a marginal bearing surface for attaching the mounting brackets 22, 24.

Each of the brackets 22, 24, in turn, supports a hanger element 32, 34 having respective apertures 36, 38. The corresponding apertures 36, 38 are in horizontal alignment and adapted to seat opposite ends of a transverse stringer member 40. A similar pair of brackets 22', 24' (not shown) and hanger elements 32', 34' support a stringer member 42. Typically, the stringer members 40, 42 can be a steel or plastic rod having a diameter of $\frac{1}{8}$ inch to $\frac{1}{4}$ inch (3–6 mm.). The stringer members 40, 42 can, of course, be formed of other structural materials and can assume other shapes as for aesthetic reasons.

Each of the two diffuser panels 12, 12' can now be positioned upon the stringers 40, 42 and will be securely supported thereby. As previously mentioned, the panels 12, 12' are positioned so as to form the light passageway 16 coextensive with each of the panels.

A pair of stirrups 44, 46 engage the stringer 40 and can be slidably positioned therealong. A similar set of stirrups 44', 46' are engageable upon the stringer 42 in like manner. Referring now to FIGS. 4 and 5, it should be noted that the stringer 44 is provided with a collar 48 substantially circumscribing the stringer 40. In a preferred embodiment, the collar 48 can be fabricated of a flexibly resilient material to permit snap fit engagement over the stringer 40. Alternatively, the stringer 40 can be placed through the collar 48 prior to accommodation within aperture 36 of the hanger member 32. It should be further noted that in the embodiment thus illustrated the upper panel 12 rests directly upon the stringer member 40. The stirrup 44 has in addition a lip 50 extending from the lower extremity. The lip 50 is adapted to provide a receiving ledge for panel 14. It should be apparent that the stirrups 44, 46 are thus manually adjustable and can be slid along the longitudinal axis of stringer 40 in the direction indicated by the broken arrow in FIG. 5 for positioning the lower diffuser panel 14 in registration with the light passageway 16. When thus positioned, it will be apparent that light waves passing through the light passageway 16, as well as light transmitted through adjacent portions of the respective diffuser panels 12, 12' will be intercepted by the diffuser panel 14 for scatterment.

Another feature of this invention relates to the incorporation of a chromatic filter 52. In the enlarged partial sectional view shown in FIG. 3, the filter 52 is engaged between the set of upper diffuser panels 12, 12'. For this purpose, a pair of channels 54, 56 in confronting edges of the respective diffuser panels 12, 12' are adapted for slidingly receiving the chromatic filter 52. The filter 52 is provided with a longitudinal mating projection 58, 60 extending along its opposite edges. The mating projection 58, 60 is adapted to be recieved within corresponding channels 54, 56 to slidingly secure the filter 52 in position. It should be apparent that the chromatic filter 52 can be furnished in different colors for selective utilization to achieve desired results, however the application of this invention is not limited to use for chromatic modification.

In an alternate embodiment shown in FIG. 7, reference numerals with the suffix "a" have been used to represent corresponding elements as shown in the previous figures. A bracket **22*a* in this instance has been provided with a retainer spring 62 for grippingly engaging a lighting fixture 26*a*. The retainer spring 62 is used in place and stead of the previously described screw clamp 28, 30. In addition, this variant embodiment includes a hanger element 32*a* provided with a shelf 36*a* for receiving a stringer 12*a*. The shelf 36*a* is used in place and stead of the aperture 36. It should be apparent that this bracket arrangement also provides attachment means for releasably securing the bracket without the need for special tools. In addition, this bracket 22*a* is readily adaptable for mounting to an existing lighting fixture. It should further be obvious that the diffuser panels 12, 12', 14 as employed in the light dispersion system 10 can readily be removed for cleaning, replacement or to permit access for relamping the fixture 26**.

Thus, it should be apparent that there is provided a light dispersion system which achieves the various objects of the invention and which is well adapted to meet the conditions of practical use. Since various possible embodiments of the invention might be made and various changes might be made in the exemplary embodiment above set forth, it is to be understood that all material shown and described in the accompanying drawings is to be interpreted as illustrative and not in a limiting sense.

I claim:

1. In combination with a recessed ceiling mounted lighting fixture having a fluorescent light source including a light transmitting panel substantially coincident with the ceiling surface, the improvement comprising a light dispersion system having a plurality of substantially planar translucent diffuser panels for use in substitution of the said light transmitting panel, attachment means including a set of brackets adapted for interfitting securement to the recessed lighting fixture for suspending the diffuser panels in substantially horizontal planes below the light source and in vertical spaced relationship from the ceiling surface extending beyond the marginal periphery of the lighting fixture whereby the diffuser panels disperse incident light emitted from the light source by refraction and reflection toward the ceiling surface to increase the effective field of illumination.

2. An improved light dispersion system as claimed in claim 1 further including an upper set of coplanar diffuser panels, said diffuser panels being separated to define therebetween a light passageway, a lower diffuser panel slidably positionable below the upper set of diffuser panels for registration with the light passageway to intercept and disperse light passing therethrough.

3. An improved light dispersion system as claimed in claim 2 further including hanger means depending from each of said brackets, a pair of transverse stringer members, the opposite ends of said stringer members being seated within the respective hanger means whereby the diffuser panels are supportable upon the transverse stringers.

4. An improved light dispersion system as claimed in claim 3 further including a stirrup, said stirrup member being slidably engageable on the stringer member for positioning the lower diffuser panel.

5. An improved light dispersion system as claimed in claim 4 wherein the stirrup member includes a flexibly resilient collar, said collar being adapted for snap fit engagement over the stringer member.

6. An improved light dispersion system as claimed in claim 5 wherein the bracket is provided with a screw clamp for securement to the lighting fixture.

7. An improved light dispersion system as claimed in claim 5 wherein the bracket is provided with a retainer spring for securement to the lighting fixture.

8. An improved light dispersion system as claimed in claim 7 further including retainer means within the upper set of diffuser panels, a chromatic filter element, said filter element being adapted for selective engagement within the retainer means for occupying the light passageway to modify the resultant color spectrum.

9. An improved light dispersion system as claimed in claim 8 wherein the diffuser panels are substantially identical in size for interchangeable substitution.

10. An improved light dispersion system as claimed in claim 9 wherein the hanger means is provided with an integral shelf for receiving the hanger.

* * * * *